US005911636A

United States Patent [19]

Schmoll

[11] Patent Number: 5,911,636

[45] Date of Patent: Jun. 15, 1999

[54] GOLF CLUB FITTING METHOD AND SYSTEM

[75] Inventor: John A. Schmoll, Cape Girardeau, Mo.

[73] Assignee: Southeast Golf, Inc., Cape Girardeau, Mo.

[21] Appl. No.: 09/007,923

[22] Filed: Jan. 16, 1998

[51] Int. Cl.[6] ..... A63B 53/00

[52] U.S. Cl. ..... 473/266; 473/409

[58] Field of Search ..... 473/409, 239, 473/246, 266

[56] References Cited

U.S. PATENT DOCUMENTS

| | | | |
|---|---|---|---|
| 4,163,941 | 8/1979 | Linn, Jr. | 324/178 |
| 4,337,049 | 6/1982 | Connelly | 434/247 |
| 4,375,887 | 3/1983 | Lynch et al. | 273/32 H |
| 5,249,967 | 10/1993 | O'Leary et al. | 434/247 |
| 5,303,924 | 4/1994 | Kluttz | 473/155 |
| 5,351,951 | 10/1994 | Hodgetts | 273/77 A |
| 5,441,256 | 8/1995 | Hackman | 273/77 A |
| 5,469,627 | 11/1995 | Denny et al. | 33/508 |
| 5,472,205 | 12/1995 | Bouton | 273/187.1 |
| 5,478,073 | 12/1995 | Hackman | 273/77 A |
| 5,486,001 | 1/1996 | Baker | 273/183.1 |
| 5,797,805 | 8/1998 | Lubell | 473/266 |

*Primary Examiner*—Steven Wong
*Assistant Examiner*—Stephen L. Blau
*Attorney, Agent, or Firm*—Senniger, Powers, Leavitt & Roedel

[57] ABSTRACT

A method of fitting a golf club includes the step of acquiring at least one recorded image of a person swinging a trial golf club to hit a golf ball approximately at the time the club impacts the ball. The recorded image is analyzed to determine an optimal geometry of the club. The information is used to determine an optimum length of a fitted club. A system for fitting a golf club includes a camera positioned with respect to a golf ball supporting surface for recording an image of a person hitting the ball. A monitor interconnected to the camera displays the image and a grid generator generates a grid on the monitor for use in making measurements to fit the club.

20 Claims, 2 Drawing Sheets

GOLF CLUB FITTING METHOD AND SYSTEM

BACKGROUND OF THE INVENTION

This invention relates generally to fitting golf clubs, and more specifically, to a method and system of determining the optimum club dimensions and configurations based on a recorded image of a golfer swinging a trial club.

All golfers may aspire to have the perfect swing. However, the fact remains that there are many differences between the way any two people swing a golf club. Some of the differences arise from a person's physical traits, which include height, arm length, posture, and build. However, there are nearly infinite stylistic variations, including stance, amount of knee bend, arm position, hand position, gripping location, and the mechanics of swing motion.

Presently, there is a wide variety of commercially available golf club designs and sizes. Club manufacturers offer selections of unique head shapes, shaft flexibility levels, material compositions, grip thicknesses, club weights, lengths, and lie angles. Properly fitted clubs for the individual golfer can significantly assist a golfer in making an accurate, consistent shot.

It has been difficult for a golfer purchasing new clubs to find the best fit to meet his or her personal characteristics. When purchasing a new set of clubs, a golfer first selects a preferred manufacturer and model. The purchaser then may be fitted with the proper size club of that model to ensure compatibility and effective use.

Two key parameters in the club fitting process are the club length and head-to-shaft angle. Each has a strong influence on the accuracy of ball flight. For good distance and distance control, a golfer must hit balls consistently and solidly in the center of the club face where the center of gravity of the club head is located. A club that is too short will result in hits from the toe of the club. Alternatively, a club that is too long will result in hits from the heel of the club. Similarly, for good directional control, the head-to-shaft angle must correspond to a lie angle where the club is level when it impacts the ball. A head-to-shaft angle that is too great results in off-center hits toward the heel, sending the ball toward the right (for right-handed golfers). A head-to-shaft angle that is too small results in off-center hits toward the toe, sending the ball toward the left.

In the past, fitting length and head-to-shaft angle has often been performed based on generic charts and measurements, or based on a trial and error process using clubs that the particular retailer has in present inventory. An example is the use of a golfer's fingertip-to-ground measurement to determine club length. This method does not tailor a club to the particular golfer's swing and its dynamics, nor find the optimum fit. Moreover, a set of clubs which is fitted based solely upon physical characteristics does nothing to accommodate the stylistic characteristics of the individual golfer.

Trial and error are rarely effective since length and lie angle are interrelated, and simply trying several clubs that the particular retailer has in stock at the time will not find the best combination without fortunate coincidence. For instance, a typical model of club has about five possible lengths and about five possible head-to-shaft angles. Few retailers have all the combinations in stock. Compounding the difficulty is the fact that while golfers may subjectively tell from a few swings whether a new club feels right to them, they can not tell whether the club is in fact the correct fit to maximize performance over time.

Another method of fitting golf clubs involves the use of impact tape, which can also provide inaccurate results. In this method, tape is placed on the sole or face of a club to record the contact locations. The golfer then hits a ball that is placed on a rigid deflection board. Impact against the rigid surface leaves a mark on the tape on the sole of the club that can indicate if the lie angle is too flat or too upright upon impact. Impact against the golf ball leaves a mark on the tape on the face of the club that can indicate if the club is too long (impact on heel) or too short (impact on toe). Unfortunately, this method requires the club to strike a rigid surface, the force from which deflects the club. The configuration of the club is thereby altered from the true swing that would be experienced by a golfer when playing on a golf course. The fit is therefore inaccurate.

Further, previous methods fit a golfer for one or two clubs, then extrapolate those results to all clubs in a set using normalized patterns. An extrapolation, however, precludes accounting for any variation in swing characteristics that an individual golfer may exhibit when using different clubs.

Thus there is a need to find the optimum combination of golf club length and head-to-shaft angle for individual golfers with a method that does not affect the swing nor influence the results sought to be measured.

SUMMARY OF THE INVENTION

Among the several objects and features of the resent invention may be noted the provision of a method for fitting golf clubs to an individual golfer; the provision of such a method which measures a golfer's swing characteristics without affecting the swing during measurement; the provision of such a method which determines the optimum length of club; and the provision of such a method which determines an optimum angle between club head and shaft; the provision of such a method which separately fits each type of club in a set.

Further among the several objects and features of the present invention may be noted the provision of a system for use in fitting of golf clubs which permits measurements of fitted club geometries from an actual swing; the provision of such a system which provides rapid club fitting information; the provision of such a system which facilitates accuracy of fitting; and the provision of such a system which is easy to use.

Generally, a method of fitting a golf club includes the step of acquiring at least one recorded image of a person swinging a trial golf club to hit a golf ball approximately at the time the club impacts the ball. The selected image is analyzed to determine a horizontal projection of a shaft of the trial golf club, and to determine the angle of elevation between the shaft and the horizontal reference plane. An optimum length of a fitted club is determined from the horizontal projection of the shaft and the angle of elevation of the shaft.

In another aspect of the present invention, a system for fitting a golf club for a person generally comprises a surface for supporting a golf ball thereon constructed and arranged so that a person may swing a trial club for hitting the golf ball from the surface. A camera for recording an image of the person swinging the trial club at least at the moment of impact of the trial club with the golf ball on the supporting surface is positioned in relation to the surface to record an image from one of the front and rear of the person swinging the trial golf club. A monitor interconnected with the camera displays the recorded image. Measuring means is capable of measuring from the recorded image the horizontal projection of a club shaft on a reference plane and the angle of elevation between the reference plane and shaft of the club.

Other objects and features of the present invention will be in part apparent and in part pointed out hereinafter.

BRIEF DESCRIPTION OF THE DRAWINGS

Corresponding reference characters indicate corresponding parts throughout the views of the drawings.

DETAILED DESCRIPTION OF THE PREFERRED EMBODIMENTS

Figure 1:
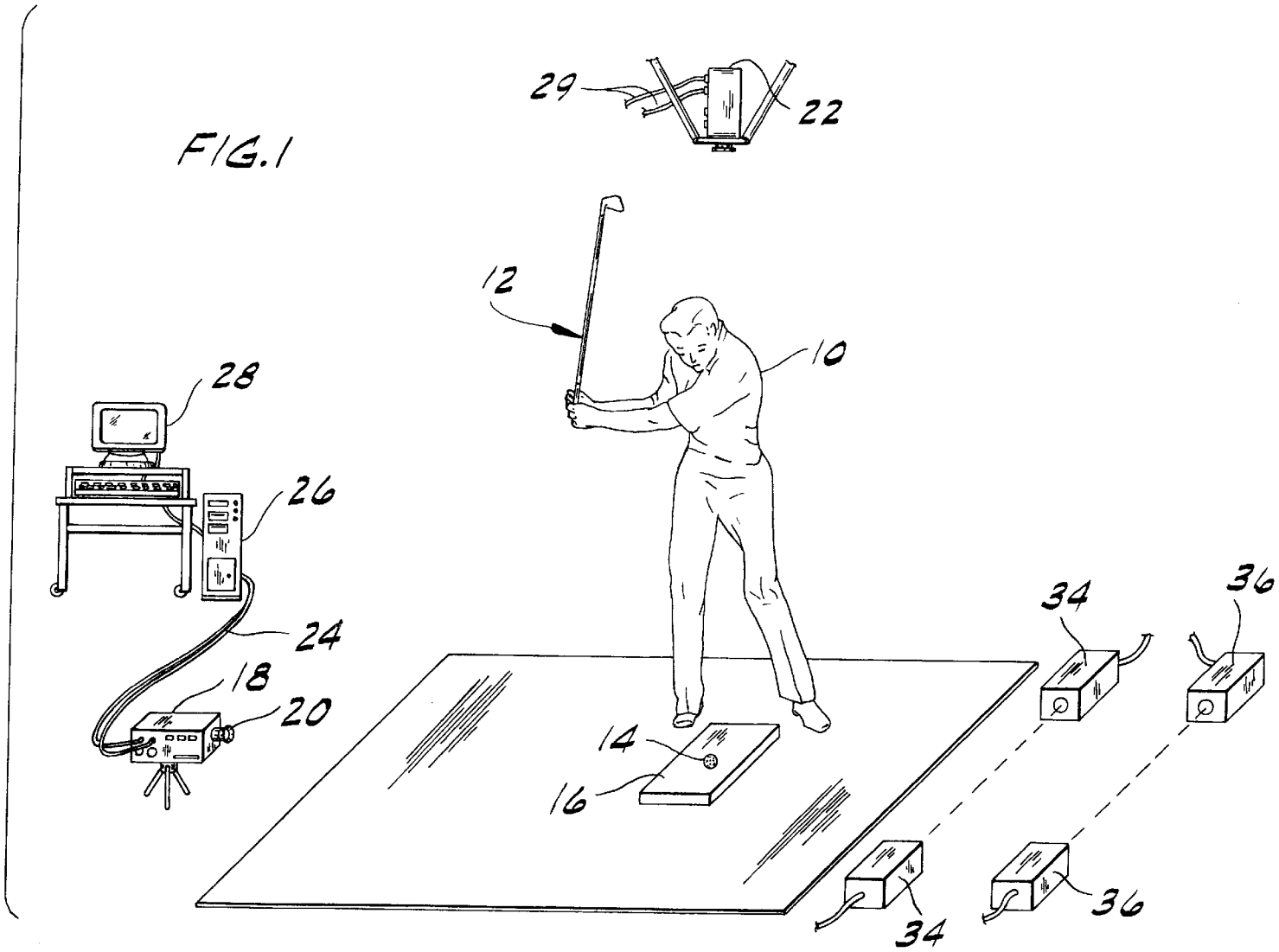
FIG. 1 is a schematic perspective view of a golf club fitting system of this invention.

Referring now to the drawings and in particular to FIG. 1, a golfer being fitted for new clubs using the method and system of the present invention is designated at 10. The golfer swings a trial golf club 12 to strike a golf ball 14 resting on a mat 16. Golf club 12 is a trial club, selected by the golfer and/or the club retailer to have the length, shaft flexibility, and head-to-shaft angle $\alpha_1$ to approximately match the physical characteristics and experience level of the golfer. The trial golf club 12 is chosen so as to result in the golfer 10 swinging at golf ball 14 in his or her typical way in view of his or her personal characteristics.

The mat 16 is constructed to minimize club deformation at impact. It is preferably made of soft and deformable foam, about one and one-half inches thick, covered by a two to three inch thick synthetic grass turf. However, other mats of different thicknesses or constructions, selected so as to minimize club deformation at impact, fall within the scope of this invention.

A first camera 18 acquires at least one recorded image of the golfer 10 swinging the trial golf club 12. In the best mode of this invention, the first camera 18 is a digital video camera capable of rapidly acquiring a series of images as the golfer 10 swings and the trial golf club 12 strikes the golf ball 14. However, other types of cameras, including conventional still cameras, could provide the image, and they do not depart from the scope of this invention.

The first camera 18 is located in a position several feet to the rear of the golfer 10 when addressing golf ball 14 on the mat 16. A lens 20 of first camera 18 is oriented so as to provide a view facing the golf ball 14, aligned in the intended direction of ball flight. The first camera 18 is located away from the golfer 10 a distance sufficiently far to ensure that it will not be inadvertently struck by the trial golf club 12, yet sufficiently close to provide a clear image. In the illustrated embodiment, the lens 20 of the first camera 18 is located at an elevation about one foot from the surface on which the golfer 10 is standing to address the ball 14.

A second camera 22 is located directly above the golf ball 14, placed so as to provide an overhead view. Images from the second camera 22 show an angle at which a head of trial golf club 12 approaches golf ball 14 during a swing, and whether a face angle of the head is squared, closed, or open as impact occurs. Images from second camera 22 are used primarily as an aid in evaluating swing dynamics and in selecting an image from first camera 18 for use in club fitting.

Other camera locations and elevations, however, do not depart from the scope of the invention. For instance, a third camera (not shown) might be on the side of the golf ball 14 opposite the golfer. Such a camera would be used primarily to examine hand position as well as other swing mechanics to determine, as discussed more fully below, the most representative swing of the golfer for use in fitting the club.

The first camera 18 is connected by a cable 24 to a computer-based image analyzer 26 and further to a monitor 28. The image analyzer 26 and monitor 28 together may be a personal computer system. The second camera 22 is similarly connected, such as by cables 29 (only a fragmentary portions of which are illustrated in FIG. 1).

Speed of golf ball 14 is measured immediately after impact using a conventional light trap apparatus. In such apparatus, there are two pairs of light generators and sensors, a first pair of the light generators/sensors being designated by the reference numeral 34 and a second pair of the light generators sensors being designated by the reference numeral 36. The two parallel light beams created by the light generator/sensor pairs 34, 36 are directed across a ball's expected path of flight and separated by a known distance. As a ball 14 passes, the time elapsed between the ball's breaking a first of the light beams L1 and the ball's breaking a second of the light beams is measured. The light generator sensor pairs 34, 36 are connected to the image analyzer 26 for calculating the speed of the ball from the separation of the light beams and the elapsed time measured. The speed of golf ball 14 is used as an aid in identifying an effective swing and in choosing an image from first camera 18 for further analysis.

A system of the preferred embodiment may include, for example, the first and second cameras 18, 22, the image analyzer 26, the monitor 28, light trap apparatus, as well as the mat 16.

Having described the system of the present invention, a preferred method of operation will now be described. The trial golf club 12 is selected which is generally believed to be of the appropriate length for the golfer 10. The golfer's physical characteristics as well as stylistic characteristics may be taken into account in selecting the trial club. The golfer 10 stands on a surface next to the mat 16 and addresses the golf ball 14 resting on the mat. The golfer takes his normal swing for that particular club 12 and hits the ball into a net or as otherwise provided for landing the ball. Images of the swing are acquired and recorded by the first and second cameras 18, 22. The speed of the ball after it is struck by the golfer 10 is measured by the light trap apparatus 30. The golfer then repeats this process several times, e.g., between five and ten times.

The recorded images of the swings from both the first camera 18 (behind the golfer 10) and second camera 22 (above the golfer) are examined using image analyzer 26 and displayed on monitor 28, along with calculated ball speed. The most representative swing of the golfer from among the recorded images is identified. Generally speaking, this is a swing where the golfer 10 had good posture and did not exhibit an unusual movement during the swing. Moreover, as judged from the images recorded by the camera 22, the representative swing would be one where the club face struck the ball 14 square, rather than slightly opened or closed. Finally, the ball speed would be used to judge that the golfer had hit the ball solidly. A poor hit by the golfer 10 would produce low ball speed.

Figure 2:
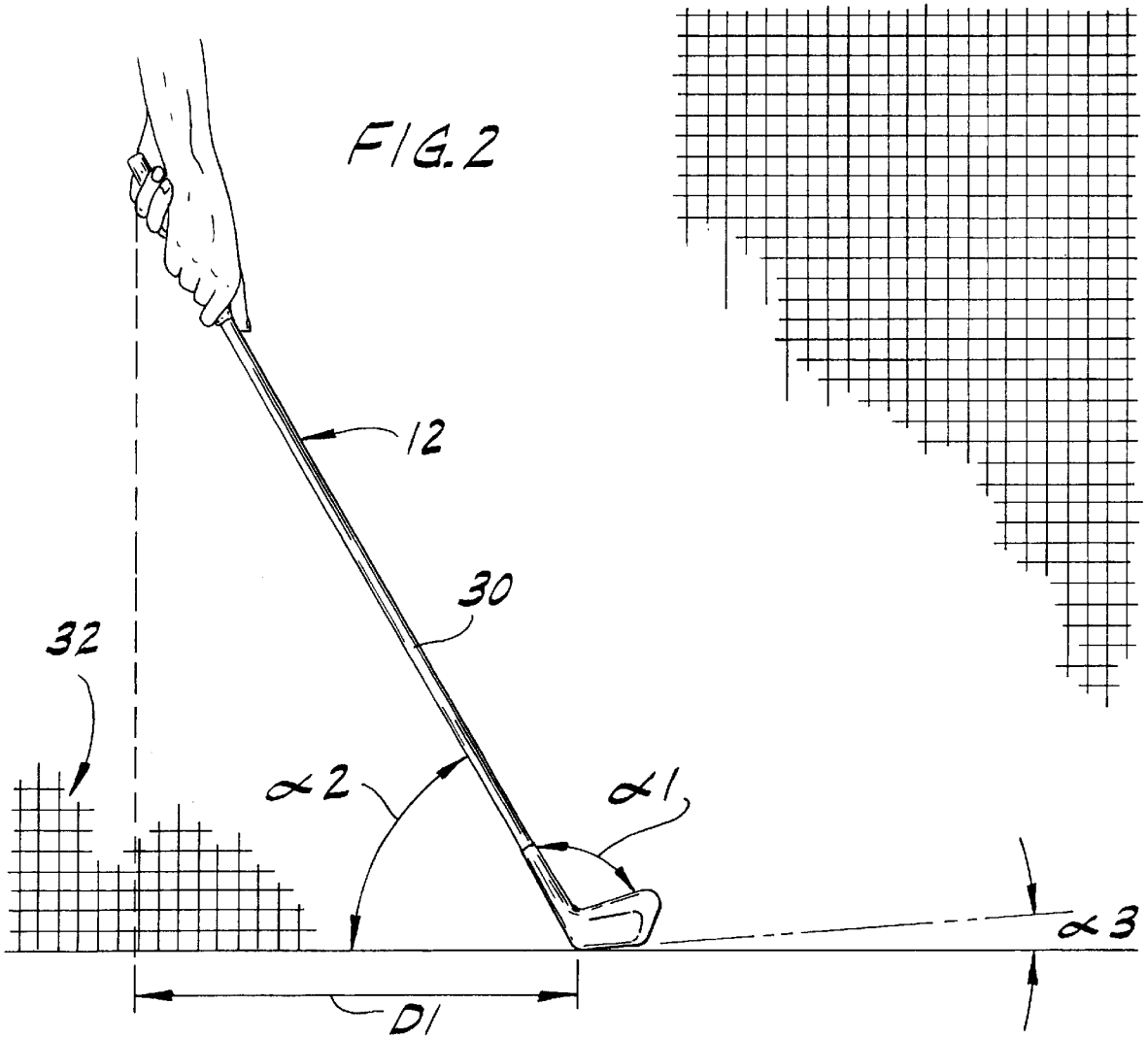
FIG. 2 is schematic of a recorded image taken at the time of club impact with ball.

Once a representative swing is isolated, an image is selected from the images taken by first camera 18 showing the trial golf club 12 at the moment it impacts the golf ball 14. A sample of such an image is shown in FIG. 2. The selected image is analyzed using a image analyzer 26 and displayed on monitor 28. Available image analyzing software would be operable to make the necessary measurements from the selected image. However, manual analysis of the selected image, such as measurements from the image using a scale or ruler, does not depart from the scope of the invention.

Referring now to FIG. 2, an example of an image selected for analysis is shown. The image shows the trial golf club 12 with shaft 30 at approximately the moment of impact with golf ball 14, along with a horizontal reference plane such as the floor. A calibrated grid 32 is overlaid or superimposed on the image. The grid may be visually perceptible as shown in FIG. 2, or it may be internal to image analyzer 26 and never displayed on monitor 28.

The grid on the image is analyzed to determine three dimensions:

1) a horizontal projection of shaft 30, which is measured by a horizontal distance D1 between a bottom of shaft 30 and a point vertically below a top of shaft,
2) an angle $\alpha_2$ of elevation between the shaft 30 and the horizontal reference plane, and
3) a lie angle $\alpha_3$ between the club bottom and the horizontal reference plane.

The dimensions are used to determine the optimum length and head-to-shaft angle for the golfer 10 for that particular club. The optimum length of club is equal to the quotient of the horizontal projection of the club shaft divided by the trigonometric cosine of the angle of elevation of the club shaft. Because the mat 16 is soft, there will be minimal club deflection at impact so a true club length reading can be obtained.

The optimum head-to-shaft angle is equal to the sum of: 1) the head-to-shaft angle $\alpha_1$ of the trial club, and 2) the difference between the measured lie angle $\alpha_3$ of the club bottom and an angle of zero (parallel to the horizontal reference plane). As shown in FIG. 2, the toe of the club is spaced above the reference plane (i.e., because the head-to-shaft angle $\alpha_1$ is too shallow for the golfer). In this instance the lie angle $\alpha_3$ is a positive angle. However, if the head-to-shaft angle had been too large, the toe would be pointing down below the reference plane. In that instance, the lie angle is considered to be a negative number. It will be readily understood that the negative lie angle, when added to the head-to-shaft angle $\alpha_1$ will result in a reduction in the head-to-shaft angle in the fitted club.

It is a feature of the present invention to repeat the foregoing steps for every club in the set.

The present invention takes into account that formalistic extrapolations for fitting other clubs in the set is not sufficient. Golfers may have different swings for different clubs. Accordingly, there are different stylistic characteristics which need to be accommodated to find the best club of each type in the set.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A method of fitting a golf club, comprising the steps of:

(a) acquiring at least one recorded image of a person swinging a trial golf club to hit a golf ball approximately at a time the club impacts the ball;

(b) analyzing the at least one acquired image to determine a horizontal projection of a shaft of the trial golf club;

(c) analyzing the at least one acquired image to determine an angle of elevation between the shaft and the horizontal reference plane;

(d) determining an optimum length of a fitted club from the horizontal projection of the shaft and the angle of elevation of the shaft.

2. A method as set forth in claim 1 further comprising the step of repeating steps (a)–(d) for plural golf clubs.

3. A method as set forth in claim 2 wherein said step of repeating comprises repeating steps (a)–(d) for each golf club in a complete set of golf clubs selected by the person for playing the game of golf.

4. A method as set forth in claim 1 further comprising the step of providing a surface on which the golf ball rests until impact by the golf club which is constructed to minimize club deformation at impact.

5. A method as set forth in claim 4 wherein said step of providing a surface comprises the step of providing a mat having deformable foam covered by synthetic grass turf.

6. A method as set forth in claim 1 wherein said step of acquiring at least one image comprises acquiring said image from a vantage selected from at least one of to a front and to a rear of the person.

7. A method as set forth in claim 6 wherein said step of acquiring at least one image comprises recording plural images during a course of at least one swing of the trial golf club and selecting from among said plural images said at least one image acquired approximately at the time the club impacts the ball.

8. A method as set forth in claim 6 further comprising the step of acquiring an image of the person swinging the trial golf club at approximately the time the club impacts the ball from a vantage overhead of the person.

9. A method as set forth in claim 1 further comprising the step of overlaying a calibrated grid on said at least one image in relation to the horizontal reference plane for use in at least one of said analyzing steps.

10. A method as set forth in claim 9 wherein said step of overlaying a grid comprises causing the grid to appear on a monitor superimposed on said selected one image.

11. A method as set forth in claim 10 further comprising the steps of:

analyzing said at least one image to determine the angle of elevation between the horizontal reference plane and a bottom edge of a head of the golf club;

determining an optimum angle between a club head and a shaft of the fitted club to make the bottom edge substantially lie in the reference plane.

12. A method of fitting a golf club, comprising the steps of:

(a) acquiring at least one recorded image approximately at a time the club impacts a ball;

(b) analyzing said at least one image to determine an angle of elevation between a horizontal reference plane and a bottom edge of a head of the golf club;

(c) determining an optimum angle between a club head and a shaft of the fitted club to make the bottom edge substantially lie in the reference plane.

13. A method as set forth in claim 12 further comprising the steps of analyzing said at least one image to determine a horizontal projection of a shaft of the trial golf club, analyzing said at least one image to determine the angle of elevation between the shaft and the horizontal reference plane, and determining an optimum length of a fitted club from the horizontal projection of the shaft and the angle of elevation of the shaft.

14. A method as set forth in claim 12 further comprising the step of repeating steps (a)–(c) for plural golf clubs.

15. A method as set forth in claim 12 further comprising the step of providing a surface on which the golf ball rests until impact by the golf club which is constructed to minimize club deformation at impact.

16. A method as set forth in claim 12 wherein said step of acquiring at least one image comprises acquiring said image from a vantage selected from at least one of to a front and to the rear of a person.

17. A method as set forth in claim 16 further comprising the step of acquiring an image of the person swinging the trial golf club at approximately the time the club impacts the ball from a vantage overhead of the person.

18. A method as set forth in claim 12 further comprising the step of overlaying a calibrated grid on said at least one image in relation to the horizontal reference plane for use in at least one of said analyzing steps.

19. A system for fitting a golf club for a person, the system comprising:

a surface for supporting a golf ball thereon constructed and arranged so that a person may swing a trial club for hitting the golf ball from the surface;

a camera for recording an image of the person swinging the trial club at least at the moment of impact of the trial club with the golf ball on the supporting surface, the camera being positioned in relation to the surface to record an image from one of a front and rear of the person swinging the trial club;

a monitor interconnected with the camera for displaying the recorded image;

means for measuring from the recorded image a horizontal projection of a club shaft on a reference plane and an angle of elevation between the reference plane and shaft of the club.

20. A system as set forth in claim 19 wherein the surface comprises a mat including deformable foam covered by synthetic grass turf, the surface being thereby constructed to minimize deflection of the trial club at impact.

* * * * *